United States Patent [19]

Kindlmann et al.

[11] Patent Number: 4,682,645

[45] Date of Patent: Jul. 28, 1987

[54] CONTROL SYSTEM FOR ELECTROMAGNETIC CASTING OF METALS

[75] Inventors: Peter J. Kindlmann, Guilford; Brian G. Lewis, Branford, both of Conn.

[73] Assignee: Olin Corporation, New Haven, Conn.

[21] Appl. No.: 835,848

[22] Filed: Mar. 3, 1986

[51] Int. Cl.[4] ..... B22D 27/02; B22D 11/18

[52] U.S. Cl. ..... 164/453; 164/467; 164/503; 164/449

[58] Field of Search ..... 164/467, 503, 452, 453, 164/150, 154, 449

[56] References Cited

U.S. PATENT DOCUMENTS

| | | |
|---|---|---|
| 3,605,865 | 9/1971 | Getselev . |
| 4,014,379 | 3/1977 | Getselev . |
| 4,161,206 | 7/1979 | Yarwood et al. . |
| 4,213,496 | 7/1980 | Yarwood et al. . |
| 4,289,946 | 9/1981 | Yarwood et al. . |
| 4,470,447 | 9/1984 | Kindlmann et al. . |
| 4,473,104 | 9/1984 | Ungarean et al. . |
| 4,495,983 | 1/1985 | Kindlmann et al. . |
| 4,522,247 | 6/1985 | Ungarean et al. . |

FOREIGN PATENT DOCUMENTS

| | | |
|---|---|---|
| 913323 | 10/1972 | Canada . |
| 273226 | 10/1970 | U.S.S.R. . |
| 338036 | 5/1977 | U.S.S.R. . |
| 338297 | 6/1972 | U.S.S.R. . |

OTHER PUBLICATIONS

". . . Develops New Molten Metal Measuring System for Continuous Casters," *Journal of Metals*, Jul. 1979, pp. 14–15.

*Primary Examiner*—Kuang Y. Lin

*Attorney, Agent, or Firm*—Howard M. Cohn; Paul Weinstein

[57] ABSTRACT

The present invention relates to a process and apparatus for controlling an electromagnetic casting system. The process and apparatus utilize at least one sense loop and an electrical parameter relating to the sense loop, e.g. the mutual inductance between the sense loop and a containment inductor, to control during casting the height of the contained head of molten material and/or the ingot size. In a first embodiment, a sense loop is positioned in the air gap between the containment inductor and the outer surface of the forming ingot or the molten metal head, preferably in a location in the vicinity of the liquid-solid interface. In a second embodiment, a plurality of sense loops are used to control the casting system.

32 Claims, 5 Drawing Figures

CONTROL SYSTEM FOR ELECTROMAGNETIC CASTING OF METALS

The present invention relates to electromagnetic casting and an apparatus and a process for using at least one sense loop to sense an electrical parameter of the casting system, e.g. mutual inductance between at least one sense loop and a containment inductor, to control head height and/or ingot size during casting.

Casting techniques are known wherein an inductance electromagnetic field rather than a mold with walls is used to both confine and shape a molten metal or metal alloy being cast. U.S. Pat. No. 3,605,865 to Getselev illustrates one such casting technique. In these casting techniques, a strong electromagnetic field is used to counterbalance the metallostatic forces effected by a head of molten metal or metal alloy. One of the most persistent problems associated with these casting techniques has been the development of effective systems for controlling the casting process. Many attempts have been made to develop appropriate control systems. For example, some systems sense the gap between the containment inductor and the metal ingot being cast or an electrical parameter related thereto and use the sensed gap to control the current to the inductor. U.S. Pat. Nos. 4,161,206, 4,213,496, and 4,289,946, all to Yarwood et al., illustrate such a system.

Other systems sense a parameter related to the liquid metal head such as head top surface location to control the casting process. This is because it is often necessary to employ relatively low heads of pressure in the molten metal to minimize electromagnetic field power requirements. Precise control of the metal or metal alloy head is highly desirable to minimize fluctuations in the metallostatic forces and prevent surges of high velocity molten metal streams within the casting. It often becomes important to know the precise molten metal head height at any given instant during the casting run and to be able to continuously monitor such location to facilitate adjustment of the casting system.

One method of head top surface measurement which has been used in electromagnetic casting systems utilizes a float to locate the upper surface of the molten metal or metal alloy being cast. U.S. Pat. No. 4,014,379, Canadian Pat. No. 913,323, and U.S.S.R. Pat. No. 338,036, all to Getselev, illustrate this type of head top surface location measurement device. One of the problems with this type of measuring system is the poor reliability often encountered when the primary measuring device is in contact with or subject to damage by the molten metal. Other problems include the risk of the float causing surface perturbations in the liquid metal which in turn cause casting defects.

Another system for locating the head top surface utilizes at least one sensing coil placed in the vicinity of the molten metal surface. In these systems, the impedance value of the coil, which varies as the molten metal moves up or down, is used as an indication of the location of the top surface of the melt. U.S.S.R. Pat. Nos. 273,226 to Kabakov et al. and 338,297 to Kurgusov, as well as the article "... Develops New Molten Metal Measuring System For Continuous Casters," *Journal of Metals*, July 1979, pp. 14–15 illustrate this type of sensing system.

Stil another system for measuring head top surface location is illustrated in U.S. Pat. No. 4,470,447 to Kindlmann et al. In this system, changes in the location of the top surface of the molten metal head are continuously displayed during a casting run by monitoring electrical parameters of the electromagnetic casting system including at least one electrical parameter of the non-magnetic shield. The monitored shield parameter may be the current in the shield, the inductance of the shield, and/or the mutual inductance between the shield and the inductor in conjunction with the driving point inductance of the inductor. By comparing the sensed electrical parameter(s) with a model, the location of the head top surface may be determined.

A system utilizing measurement of the in-phase component of the conductor current during the electromagnetic casting process as an indication of the height of the liquid metal head and the location of the liquid-solid interface is shown in U.S. Pat. No. 4,495,983 to Kindlmann et al. At constant frequency and knowing the air gap between the inductor and the load as well as the load surface height, this system permits determination of the actual depth of the liquid metal head and location of the liquid-solid interface by utilizing the different resistivities of the solid and liquid states of the metal alloy being cast. One of the advantages of this system is that it allows determination of the actual liquid metal head height and the liquid-solid interface position without probes or separate measuring devices within the primary electromagnetic casting station.

It is also known to utilize a plurality of fiber optic elements secured within elements of an electromagnetic casting system, e.g. within the shield, and/or manifold, and/or inductor, to measure and determine the load height and location of the liquid-solid interface. In such a system infrared radiation emitted from the surface of the forming ingot is used as a measure of the desired parameters. U.S. Pat. No. 4,522,247 to Ungarean et al. illustrates such a system.

In still another system, the flow of molten metal into the containment zone is controlled by sensing the metallostatic pressure exerted by the molten metal in the containment zone. This type of system is useful in that it enables one to minimize changes in the metallostatic pressure. U.S. Pat. No. 4,473,104 to Ungarean et al. illustrates such a flow control system.

Despite the existence of these control systems, it is believed that more sensitive electromagnetic casting control systems are needed to better control ingot size and/or liquid metal head. As used herein, the term ingot means the solid product formed by the casting process.

Accordingly, it is an object of the present invention to provide an electromagnetic casting control system having improved control over ingot size and/or liquid metal head.

It is a further object of the present invention to provide a control system as above having increased sensitivity.

It is still a further object of the present invention to provide a system as above which may be used in both continuous and semi-continuous electromagnetic casting.

These and other objects and advantages will become apparent from the following description and drawings in which like reference numerals depict like elements.

The present invention relates to an improved apparatus and process for controlling ingot size and/or liquid metal head during electromagnetic casting. The control system of the present invention utilizes at least one non-powered sense loop, distinct from the containment inductor, as a means for sensing and/or measuring an electrical parameter of the casting system. Preferably, the sensed electrical parameter is related to the current induced in the sense loop by the containment inductor. For example, the sensed electrical parameter may be the mutual inductance between the sense loop and the containment inductor. The sensed or measured electrical parameter is used to generate an error signal which in turn is used to control ingot size and/or liquid metal head. It has been found that one can obtain improved control over the casting process by positioning the sense loop(s) to be particularly sensitive to variations in the air gap between the containment inductor and the outer surface of the forming ingot and/or the liquid metal head.

To obtain an increase in sensitivity, at least one sense loop is positioned between an inner surface of the containment inductor and an outer surface of at least one of the ingot and the molten metal head in a plane substantially transverse to the casting direction, preferably as close as possible to the outer surface of the ingot or the molten metal head. Each sense loop is also positioned at a location along an axis parallel to the casting direction in the range of from about a point substantially equal to the head height downstream of the liquid-solid interface to a point about one-half the head height upstream of the liquid-solid interface. As used herein, the term head height means the height of the molten metal head as measured in the casting direction from the top or upstream surface of the molten metal head to the liquid-solid interface at the outer periphery of the molten metal head. Preferably, the location of each sense loop is in the range of from a point about said liquid-solid interface to a point about one-half said head height upstream of said interface.

By positioning at least one sense loop as described herein, the sense loop(s) becomes more sensitive to air gap and substantially less sensitive to head top surface location. Preferably, the effects of head top surface location on the sense loop(s) is minimized. In addition, it is possible to better sense that portion of the containment inductor's flux adjacent the liquid metal portion of the casting while having the at least one sense loop less sensitive to the solid portion of the ingot.

In an alternative embodiment of the control system of the present invention, at least one additional sense loop is provided. This additional sense loop is positioned along an axis parallel to the casting direction at a location in the range of from about 1 to about 3 times the head height above the liquid-solid interface and preferably, from about 1.5 to about 2 times the head height above the liquid-solid interface. By positioning the additional sense loop(s) in accordance with the foregoing discussion, the additional sense loop(s) are substantially affected by top surface location as compared to the sense loop(s) positioned in the vicinity of the liquid-solid interface. In this alternative control system embodiment, the measured mutual inductances of each sense loop are combined to control casting parameters related to ingot size and liquid metal head.

In addition to location, the cross sectional dimension, i.e. diameter, of each sense loop in the casting direction plays an important role in increasing system sensitivity. Generally, the smaller the cross sectional dimension of the sense loop, the more localized the region being sensed. It has been found to be desirable for the sense loop to have a cross sectional dimension less than about 50% of the head height, preferably less than about 25% of the head height, and most preferably less than about 10% of the head height. By using a sense loop that is small with respect to head height, one is able to look more selectively and sensitively at changes, in the plane of the loop, relating to the air gap and/or liquid metal head. This is because the sense loop averages the flux over a smaller height along the forming ingot.

As previously discussed, the present invention relates to an improved electromagnetic casting system. The control system described herein is believed to provide improved control over ingot size and/or liquid metal head during casting. This system may be used for both continuous and semi-continuous electromagnetic casting in any desired direction, e.g. horizontal or vertical.

Figure 1:
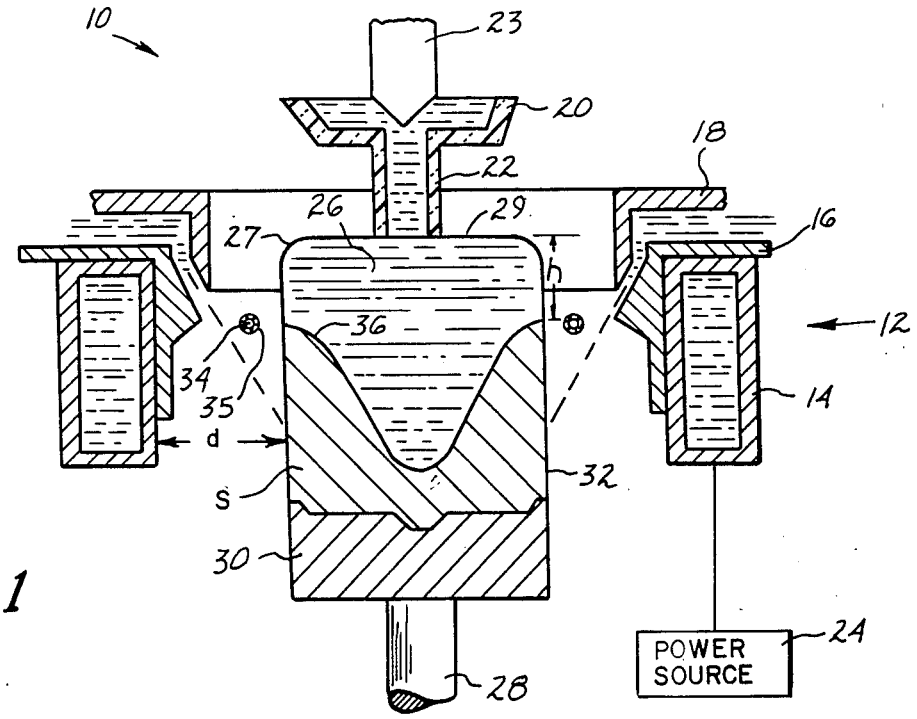
FIG. 1 is a cross sectional view of an electromagnetic casting system in accordance with the present invention.

Referring now to FIG. 1, there is shown an electromagnetic casting apparatus 10. The apparatus includes an electromagnetic casting mold 12 comprising a containment inductor 14, a manifold 16 for applying cooling water to the external surface of the metal being cast, and a non-magnetic shield 18. If desired, the inductor 14 may be water cooled using any appropriate cooling arrangement known in the art. Molten metal is semi-continuously or continuously introduced into the mold 12 during the casting run using a trough 20, down spout 22 and a conventional molten metal flow control device 23 such as a metering pin. A power source 24 applies an alternating current and a voltage to the containment inductor 14.

The inductor 14 is used to create an alternating electromagnetic field around the molten metal stream. This field induces an alternating current flow around the perimeter of the molten metal. Forces resulting from the interaction of this current with the magnetic field compress the molten metal and impart a desired shape to the molten metal. The shape imparted to the molten metal generally corresponds to the shape of the inductor, while the geometrical dimensions imparted to the molten metal depend upon the intensity of the electromagnetic field. The inductor 14 may have any desired shape, including a circular or rectangular configuration, to obtain a desired ingot cross section. Generally, an air gap "d" exists between the containment inductor's inner surface and the outer surface 32 of the solid portion of the forming ingot as well as between the inner surface of the inductor and the outer periphery 27 of the molten metal head 26.

The non-magnetic shield 18 is intended to balance the magnetic pressure with the metallostatic pressure of the molten metal head 26. It diverts a portion of the containment inductor's flux into the gap between the shield and the inductor. The non-magnetic screen 18 may comprise a separate element or may, if desired, be incorporated as a unitary part of the coolant manifold 16.

Initially, a conventional ram 28 and bottom block 30 are held in the magnetic containment zone of the mold 12 to allow the molten metal to be poured into the mold at the start of the casting run. The ram 28 and the bottom block 30 are then withdrawn at a desired casting rate.

Solidification of the molten metal which is magnetically contained in the mold 12 is achieved by direct application of water from the cooling manifold 16 to the ingot surface 32. As shown in FIG. 1, the water may be applied to the ingot surface 32 within the confines of the inductor 14. If desired, the water may be applied to the ingot surface 32 at any suitable location such as a location below the inductor 14. Still further, the water may be applied at more than one location along the ingot surface 32. For example, a second cooling manifold not shown may be positioned below the inductor 14.

As previously discussed, some believe that an improved control system is needed to provide improved control over the liquid metal head, in particular the head height "h", and/or the ingot size. As used herein, the head height "h" is the distance measured in the casting direction along the outer periphery 27 of the molten metal head 26 from the liquid-solid interface 36 of the head top surface location 29. The present invention provides improved control over the casting process by using at least one non-powered sense loop 34, distinct from the containment inductor, to sense or measure an electrical parameter of the casting system. Preferably, the sensed or measured parameter is an electrical parameter relating to the current induced in the sense loop 34 by the containment inductor 14 such as the mutual inductace between the sense loop and the containment inductor. Mutual inductance has been found to be a particularly useful parameter for controlling the liquid metal head and/or the ingot size.

Mutual inductance relates the flux intercepted by a first loop to the flux generating current in a second loop such as the inductor. Self inductance on the other hand relates the flux generated within a loop to the current flowing through that loop. The benefits of a mutual inductance sensing technique as set forth herein are believed to include: (1) greater sensitivity to liquid metal position and less susceptibility to errors due to thermal distortions in the mold; (2) greater ability to measure the initial rise of the head above the bottom block during start-up; and (3) greater stability in head containment during the casting run.

Referring now to the control aspects of the present invention, the casting apparatus shown in FIG. 1 has a sense loop 34, circumferentially surrounding the molten metal head 26 and/or the forming ingot S for sensing an electrical parameter of the system, preferably an electrical parameter of the sense loop 34 which is a function of the current induced in the sense loop 34 by the inductor 14. Most preferably, the sensed parameter is the mutual inductance between the sense loop 34 and the inductor 14. The sense loop 34 is unpowered and separate and distinct from the inductor 14. The sense loop 34 may have any desired configuration and/or cross sectional shape. In most situations, the sense loop configuration will correspond to the shape of the ingot being cast.

The sense loop 34 may be formed from any suitable electrically conductive material known in the art, e.g. a metal or metal alloy, and may be coated with an electrical insulating material 35 if desired. For example, the sense loop 34 may be a copper ribbon coil or wire coated with a ceramic material such as alumina or a carbide material.

It has been found that the position of the sense loop 34 relative to the metal or metal alloy being cast is critical if the sense loop is to be more sensitive to air gap. Preferably, the sense loop's sensitivity to air gap measurement is maximized while its sensitivity to head top surface location is minimized. Positioning is also important in rendering the sense loop more responsive to changes in liquid metal head dimension and less sensitive to the solid portion of the ingot. The solid portion of the ingot represents a history of earlier liquid dimension including any transient perturbations. If these perturbations, frozen into the solid, continue to affect the measured parameter, containment control stability is generally compromised. Movement of or changes in the liquid metal head influence the distribution of the magnetic flux. One is in part able to obtain improved control over the electromagnetic casting process by sensing those flux changes in the region adjacent to the liquid metal head.

In the casting apparatus shown in FIG. 1, the sense loop 34 is positioned in a plane substantially transverse to the casting direction within the air gap "d" between the inner surface of the inductor 14 and the outer surface 32 of the solid portion of the ingot and/or the outer periphery 27 of the molten metal head 26. As used herein, the term casting direction refers to the direction from which the solid product or ingot S emerges from the containment inductor 14. While it is desirable to place the sense loop as close as possible to the ingot outer surface 32 and/or the head outer periphery 27 to maximize sensitivity to air gap, the sense loop 34 may be positioned as far as about two-thirds of the air gap from the ingot outer surface 32 and/or the head outer periphery 27. Preferably, the sense loop 34 is positioned within the range of from as close as possible to said ingot outer surface 32 and/or head outer periphery 27 to about one-half said air gap from said ingot surface 32 and/or head periphery 27. Most preferably, the sense loop is positioned within the range from as close as possible to said ingot outer surface 32 and/or head outer periphery 27 to about one-quarter of said air gap from said ingot surface 32 and/or head periphery 27.

The sense loop 34 must also be critically positioned along an axis parallel to the casting direction to obtain the desired improvement in sensitivity. To this end, the sense loop 34 is positioned at a location in the range of from about a point substantially equal to the head height "h" downstream of the interface 36 between the solid product and the molten metal head to a point substantially equal to about one-half the head height upstream of the interface 36. Preferably, the sense loop 34 is positioned along said parallel axis at a location in the range of from a point at about the interface 36 to a point about one-half of the head height upstream of the interface. The preferred sense loop position is also desirable because the mutual inductance sensing is dominated by the liquid metal head and less sensitive to the solid portion of the ingot. This is because the sensed flux is the localized flux in the vicinity of the liquid metal head.

In addition to position, the size of the cross sectional dimension, i.e. diameter, of the sense loop 34 in the direction of casting is significant. Improved sensitivity can be obtained by using a sense loop having a cross sectional dimension in the casting direction substantially less than that of the head height. This is because such a sense loop averages the flux over a smaller height along the forming ingot, thus, permitting very localized sensitivity to changes in the air gap and/or liquid metal head.

To obtain the desired sensitivity improvements, the sense loop should have a cross sectional dimension in the casting direction less than about 50% of the head height "h". Preferably, the sense loop cross sectional dimension is less than about 25% of the head height and most preferably, less than about 10% of the head height.

Figure 2:
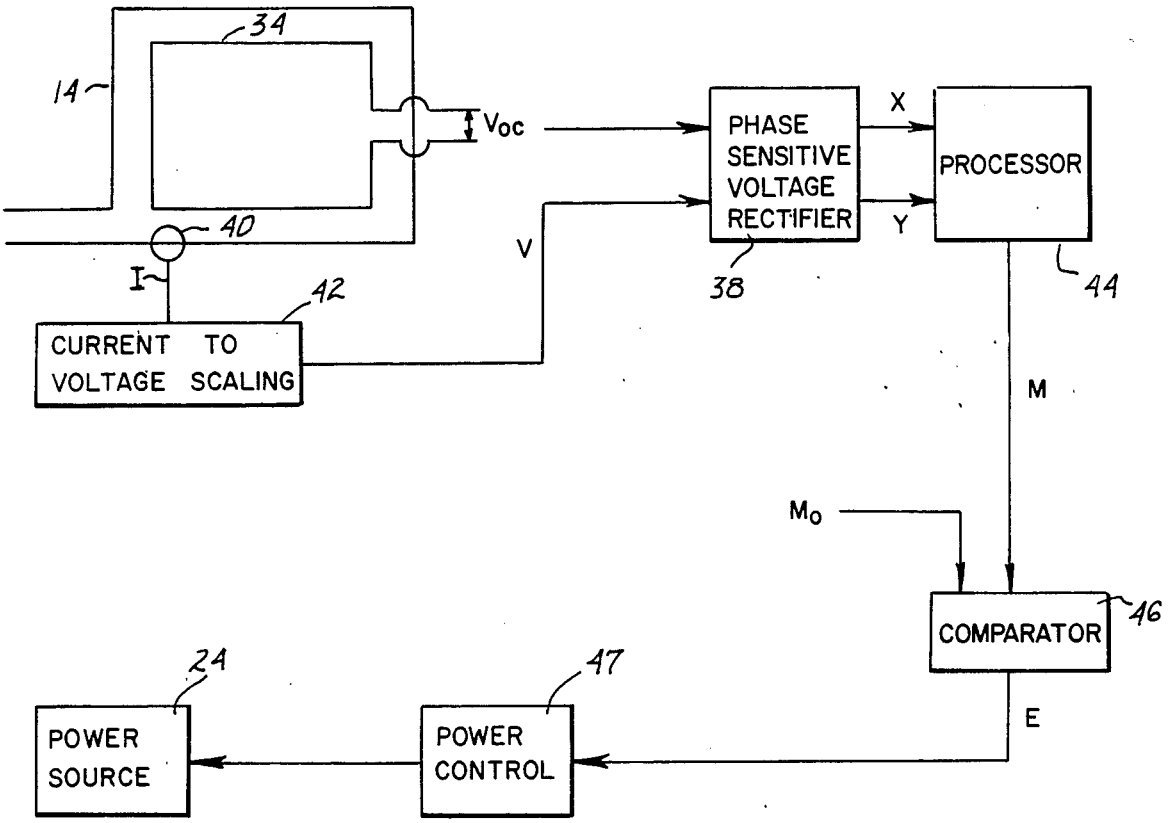
FIG. 2 is a block diagram of a portion of the control system of the present invention.

The sense loop 34 may be supported within the electromagnetic casting apparatus 10 in any desired manner. For example, the sense loop 34 may be positioned on a surface of the shield 18, e.g. mounted to the inner surface of the shield, assuming the shield extends close enough to the liquid-solid interface and the outer periphery 27 of the head to meet the aforementioned position limitations. Alternatively, a ceramic insert not shown mounted to or on the shield 18 may be used to suspend the sense loop 34 in the desired location.

Where the mutual inductance between the sense loop 34 and the inductor 14 is used as the sense parameter, the electromagnetic casting process may be controlled by comparing the sensed mutual inductance M to a set mutual inductance $M_o$. The deviation E from the set mutual inductance may be used to adjust the current and/or voltage applied to the inductor 14 and in this manner control ingot size. FIG. 2 represents a block diagram of a mutual inductance control scheme.

Referring now to FIG. 2, the mutual inductance between the sense loop 34 and the inductor 14 may be determined by measuring in any desired manner the open circuit voltage $V_{oc}$ in the sense loop 34 and supplying it to a phase sensitive voltage rectifier 38. The current I in the inductor 14 may be measured using a current transformer 40. The measured inductor current I is converted into a voltage signal V by a current to voltage scaling resistor network 42 whose output is also supplied to the phase sensitive voltage rectifier 38. The output Y from the rectifier 38 represents the magnitude of the inductor current's fundamental frequency component. The output X represents the magnitude of the component of the open circuit voltage $V_{oc}$ that is 90° out of phase with the inductor current. The X and Y signals are processed by a processor 44 in accordance with the following equation to obtain the mutual inductance:

$$M=(X/2\pi fY) \quad (1)$$

where f = the frequency of the current applied to the inductor 14.

Processor 44 may comprise any suitable electrical circuit known in the art or a computer. The mutual inductance M between the sense loop and the inductor is then compared to the preset mutual inductance $M_o$ by a comparator 46 to produce the error signal E. Comparator 46 may comprise any suitable comparator known in the art. If desired, comparator 46 may contain an appropriate amplifying circuit to provide an amplified error signal. The error signal E generated by the comparator 46 is fed into a control loop 47 for the power source 24 to adjust the current and/or voltage applied to the inductor 14 by the power source 24.

The combined functions of rectifier 38 and processor 44 can also be performed by a fast digital signal processor not shown equipped with analog-to-digital conversion capabilities of sufficient speed and resolution.

It has been found that the above system has at least a two-fold increase in sensitivity as compared to a self-inductance sensing system such as that shown in U.S. Pat. No. 4,161,206 to Yarwood et al. Potentially, the system of the present invention may have a ten-fold increase in sensitivity. This increase in sensitivity is clearly related to the positioning and/or size of the sense loop 34.

Figure 3:
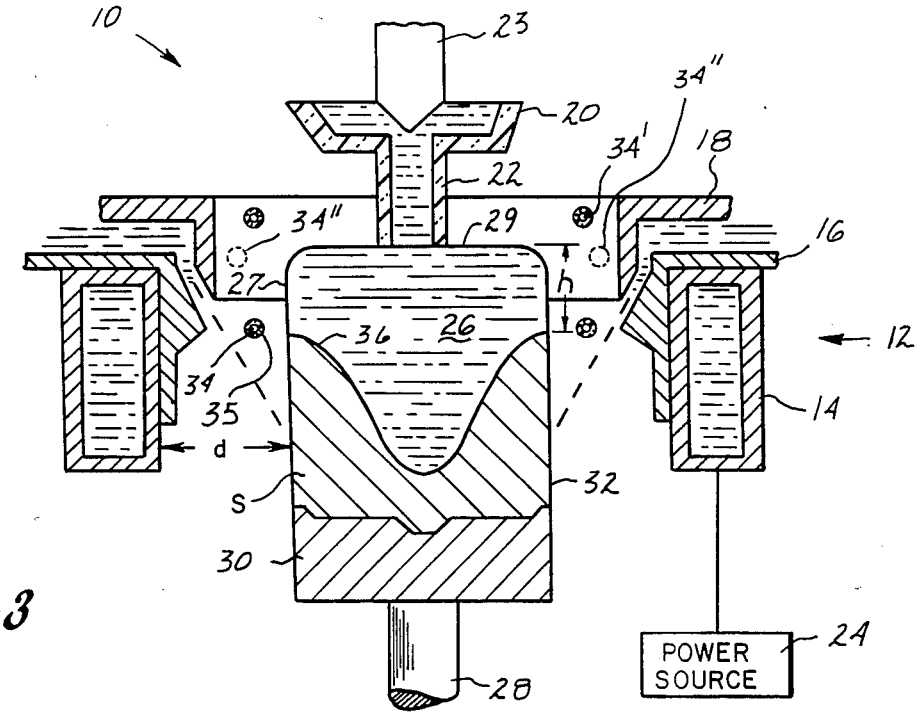
FIG. 3 is a cross sectional view of an alternative electromagnetic casting system embodiment in accordance with the present invention.

Referring now to FIG. 3, an alternative embodiment of an electromagnetic casting apparatus in accordance with the present invention is illustrated. This embodiment differs from the embodiment of FIG. 1 in that a plurality of sense loops 34 and 34' are used. The lower sense loop 34 may be positioned and have a cross sectional dimension as previously discussed in connection with the embodiment of FIG. 1 so that it is minimally affected by the location of the head top surface 27 and more sensitive to air gap. As before, the lower sense loop 34 may be supported in any desired fashion.

The second sense loop 34' on the other hand is positioned to be more sensitive to the location of the head top surface 27 than the sense loop 34. Thus, the sense loop 34' is positioned in a plane substantially transverse to the casting direction at a location along an axis parallel to the casting direction in the range of from about one to about three times the head height "h" upstream of the liquid-solid interface 36. Preferably, the sense loop 34' is positioned along said parallel axis at a location in the range of from about 1.5 to about 2 times the head height upstream of the liquid-solid interface 36. With respect to the lateral position of the sense loop 34' relative to the casting direction, the sense loop 34' may have any desired lateral location as long as it is within the electromagnetic field. Additionally, the sense loop 34' may be supported in any desired manner by any suitable means (not shown) known in the art. For example, the sense loop 34' may be positioned adjacent to or mounted on the shield 18. The size or cross sectional dimension in the casting direction of the upper sense loop 34' should be in accord with the aforementioned size considerations for the lower loop 34.

Figure 4:
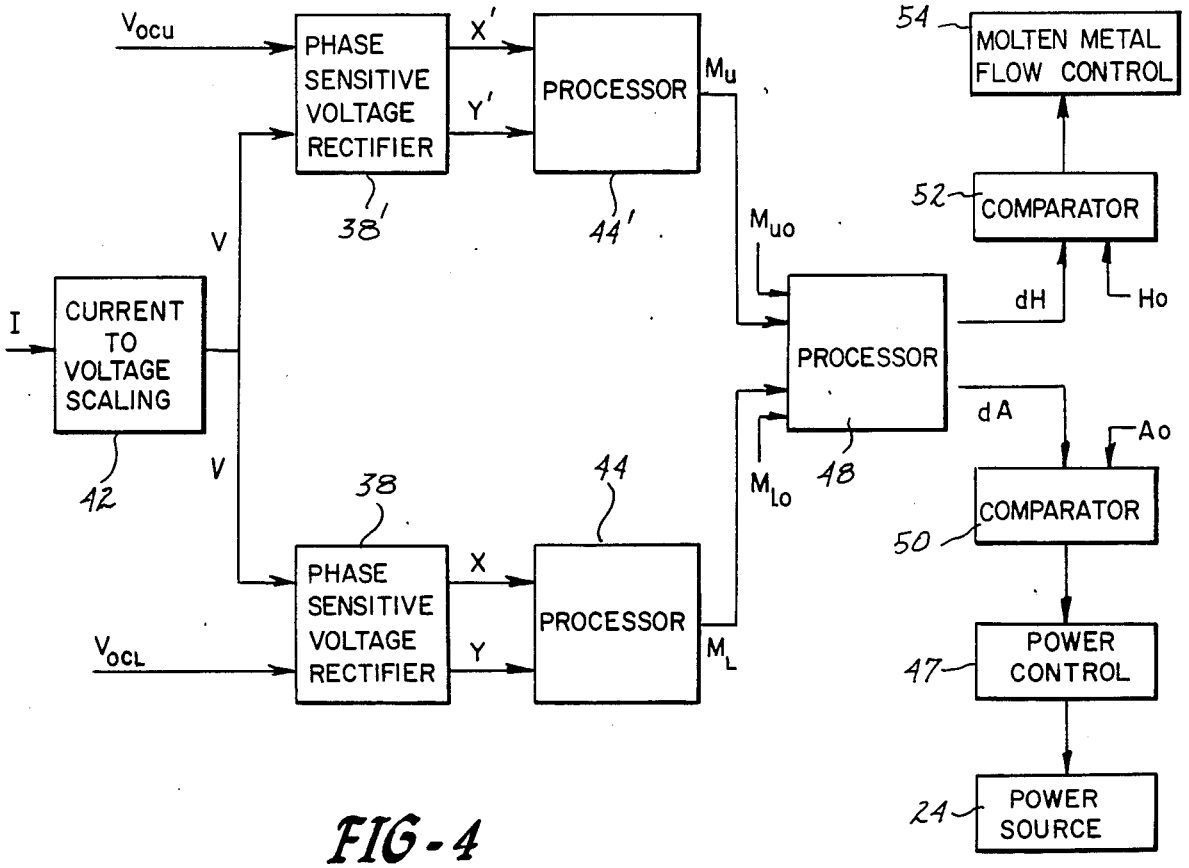
FIG. 4 is a block diagram of a portion of the control system used in conjunction with the embodiment of FIG. 3.

FIG. 4 represents a block diagram of a scheme for controlling the electromagnetic casting process in response to the mutual inductance between each of the sense loops 34 and 34' and the containment inductor 14. Referring now to FIG. 4, the mutual inductances measured by the lower sense loop 34 and the upper sense loop 34', $M_L$ and $M_U$, respectively, may be determined as in the control scheme of FIG. 2 by measuring the open circuit voltage of each sense loop. The respective open circuit voltages, $V_{OCL}$ and $V_{OCU}$, of the sense loops 34 and 34' may be measured in any desired manner known in the art. Additionally, the current I in the inductor 14 may be measured using a current transformer. As before, the inductor current I may be converted into a voltage signal V by a current to voltage scaling resistor network 42.

The lower sense loop open circuit voltage $V_{OCL}$ and the voltage signal V are supplied to a first phase sensitive voltage rectifier 38 to generate as before a signal X representative of the magnitude of the component of $V_{OCL}$ that is 90° out of phase with the inductor current and a signal Y representative of the inductor current's fundamental frequency component. The signals X and Y are then processed by a first processor 44 in accordance with equation (1) to generate a lower mutual inductance signal $M_L$. The upper sense loop open circuit voltage $V_{OCU}$ and the voltage signal V meanwhile are supplied to a second phase voltage rectifier 38' to generate signals X' and Y'. As before, the signal X' is representative of the magnitude of the component of $V_{OCU}$ that is 90° out of phase with the inductor current and the signal Y' is representative of the inductor current's fundamental frequency component. The signals X' and Y' are processed by processor 44' in accordance with equation (1) to generate an upper mutual inductance signal $M_U$. The processors 44 and 44' may comprise any suitable electrical circuit known in the art or a computer. Alternatively, the combined functions of the rectifiers 38, 38' and the processors 44, 44' may be performed by a fast digital signal processor equipped with analog-to-digital conversion capabilities of sufficient speed and resolution.

The lower and upper mutual inductance values, $M_L$ and $M_U$, respectively, are fed into a processor 48 along with a lower mutual inductance set point $M_{Lo}$ and an upper mutual inductance set point $M_{Uo}$. The processor 48 may also comprise an appropriate electrical circuit or a computer. The processor 48 generates a first signal "dA" representative of the air gap "d" and a second signal "dH" representative of the location of the top surface 29 of the molten metal head 26 by solving the following equations for dA and dH:

$$M_U = M_{Uo} + (C_U dH + K_U dA) \quad (2)$$

where $M_U$=the mutual inductance of the upper sense loop;
$M_{Uo}$=the set mutual inductance of the upper sense loop;
$C_U$=a function related to ingot cross section;
dH=head top surface location;
$K_U$=a function related to ingot cross section; and
dA=air gap;

and $$M_L = M_{Lo} + (C_L dH + K_L dA) \quad (3)$$

where $M_L$=the mutual inductance of the lower sense loop;
$M_{Lo}$=the set mutual inductance of the lower sense loop;
$C_L$=a function related to ingot cross section;
dH=head top surface location;
$K_L$=a function related to ingot cross section; and
dA=air gap.

For any given system, the values of $C_U$, $C_L$, $K_U$ and $K_L$ may be predetermined and therefore, constitute known values. Predetermination of the values for $C_U$, $C_L$, $K_U$, and $K_L$ may be done through direct physical modeling such as that described in U.S. Pat. No. 4,470,447 to Kindlmann et al. which is hereby incorporated by reference herein.

The signal dA is fed to a comparator 50 along with a set or desired air gap $A_o$. By specifying a set or desired air gap, one can specify a set or desired ingot size. The error signal from the comparator 50 is supplied to the control loop 47 for the power source 24 to adjust the current and/or the voltage being applied to the inductor 14. The signal dH is fed to a comparator 52 along with a set or desired top surface position $H_o$. The error signal produced by the comparator 52 is then used to control the volume of molten metal entering the casting apparatus 10, thereby controlling the liquid metal head. For example, the error signal may be fed to a control apparatus 54 for opening or closing the molten metal flow control device 23. By controlling air gap and molten metal input, one is able to control ingot size and liquid metal head height. The comparators 50 and 52 may comprise any suitable electrical circuits known in the art. If desired, each comparator may include an amplifying circuit.

When a computer is used for the processor(s) 44, 44' and/or 48, the computer may be programmed in any desired manner known in the art. Thus, the programming forms no part of the present invention.

Figure 5:
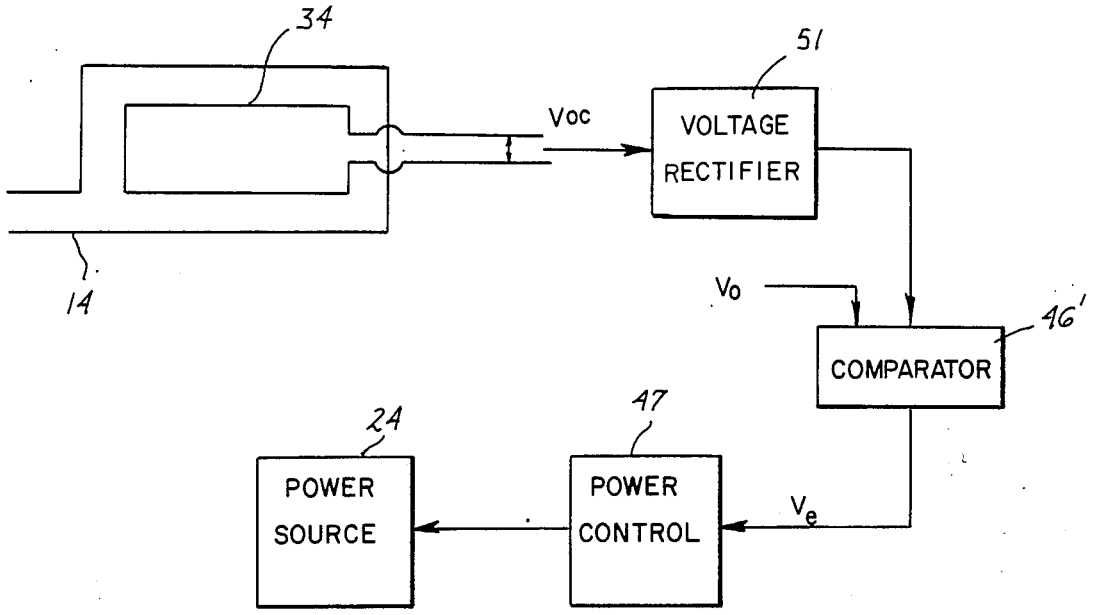
FIG. 5 is a block diagram of yet another alternative control system for use with the casting system of FIG. 1.

While the mutual inductance of the sense loop(s) is a preferred means for controlling the electromagnetic casting system, the magnitude of the sense loop open circuit voltage $V_{oc}$ may also be used as a control parameter. Referring now to FIG. 5, the open circuit voltage $V_{oc}$ of the sense loop 34 is monitored and rectified by voltage rectifier 51 without regard to the harmonic content or the phase of the inductor current. The rectified voltage is then compared to a set or desired voltage $V_o$ by a comparator 46' and a voltage error signal $V_e$ is generated. The voltage error signal $V_e$ may be applied to the control loop 47 for the power source 24 to adjust the voltage and/or the current applied to the inductor by the power source 24.

While the system in FIG. 1 uses a single sense loop for control purposes, it is possible to use a plurality of sense loops between the inductor and the outer surface 32 of forming ingot and/or the outer periphery 27 of the molten metal head 26 for control.

While FIG. 3 illustrates a control system with two sense loops, more than two sense loops may be used if so desired. For example, a third sense loop 34'' may be positioned intermediate the lower sense loop 34 and the upper sense loop 34'. When used, the third sense loop 34'' may be positioned in a plane substantially transverse to the casting direction at a point along an axis parallel to the casting direction substantially at the level of the top surface 29 of the liquid metal head. Preferably, the sense loop 34'', when used, is located between the shield 18 and the outer periphery of the liquid metal head.

While it is preferred to position the sense loop 34 as close as possible to the ingot surface 32, the sense loop 34 may be positioned adjacent to or mounted to the inner surface of the inductor 14 if so desired. When mounted to the inductor 14, the sense loop 34 may be mounted in any suitable manner known in the art.

While it is preferred to use a ribbon of copper for each sense loop, a metal or metal alloy tape or wire, an evaporated metal or metal alloy layer, or a sprayed metal or metal alloy layer may be used as a sense loop. The ribbon, wire, coil, tape, evaporated metal layer, and/or sprayed layer may be formed from any suitable metal or metal alloy.

If desired, the mutual inductance(s) between the containment inductor and one or more sense loops may be used as part of a control system such as that shown in U.S. Pat. No. 4,014,379 to Getselev, which is hereby incorporated by reference herein. In such a system, the mutual inductance error signal may be supplied to the power amplifier in lieu of the signal from the liquid zone level indicator and used to adjust the current flowing through the inductor.

The patents, publications and foreign patent publications set forth in the specification are intended to be incorporated by reference herein.

It is apparent that there has been provided in accordance with this invention a control system for electromagnetic casting of metals which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed:

1. An apparatus including:

means for electromagnetically containing a head of molten material and for forming said molten material into a solid product having a desired shape;

said solid product emerging from said containing and forming means in a desired casting direction;

a boundary between said molten material head and said solid product comprising a liquid-solid interface;

said head of molten material having a height comprising a distance measured in said casting direction along an outer surface of said molten material head from said liquid-solid interface to an upstream surface of said molten material;

said containing and forming means comprising a containment inductor and means for applying a current and a voltage to said inductor to thereby generate and apply a magnetic field to contain said molten material and to form said molten material into said desired shape;

a sense loop positioned between an inner surface of said inductor and an outer surface of at least one of said molten material head and said solid product in a plane substantially transverse to said casting direction; and said sense loop being positioned along an axis parallel to said casting direction at a location in the range of from about a point substantially equal to said height of said molten metal head downstream of said liquid-solid interface to a point substantially equal to about one-half of said height of said molten metal head upstream of said interface.

2. The apparatus of claim 1 further comprising:

said sense loop monitoring an electrical parameter of said sense loop which is a function of the current induced in said sense loop by said inductor.

3. The apparatus of claim 2 further comprising said sensed parameter being used to adjust at least one of said voltage and said current applied to said inductor.

4. The apparatus of claim 3 further comprising said sensed parameter being the mutual inductance between said sense loop and said inductor.

5. The apparatus of claim 1 further comprising:

said sense loop being positioned along said axis at a location in the range of from said interface to said about one-half said head height upstream of said interface.

6. The apparatus of claim 3 further comprising:

said sensed parameter being the open circuit voltage of said sense loop;

means for rectifying said sensed open circuit voltage;

means for comparing said rectified voltage with a set voltage and for generating a voltage error signal; and means for adjusting said voltage to said inductor in response to said error signal.

7. A casting apparatus including:

means for electromagnetically containing a head of molten material and for forming said molten material into a solid product having a desired shape and size;

said solid product emerging from said containing and forming means in a desired casting direction;

a boundary between said head of molten material and said solid product comprising a liquid-solid interface;

said head of molten material having a height comprising a distance measured in said casting direction along an outer surface of said molten material head from said liquid-solid interface to an upstream surface of said molten material;

said containing and forming means comprising a containment inductor and means for applying a current and a voltage to said inductor to thereby generate and apply a magnetic field to contain said molten material and to form said molten material into said desired shape;

a first sense loop positioned between an inner surface of said inductor and at least one of an outer surface of said solid product and said outer surface of said molten material head in a first plane substantially transverse to said casting direction;

said sense loop measuring a first mutual inductance between said sense loop and said inductor;

wherein said first sense loop located at a position along a first axis parallel to said casting direction in the range of from about a point substantially equal to said head height downstream of said interface to a point about one-half said head height upstream of said interface; and means for controlling at least one of said said molten material head height and said product size in response to said first mutual inductance.

8. The apparatus of claim 7 further comprising:

said first sense loop being located at a position along said first axis in the range of from about said interface to about said one-half said head height upstream of said interface.

9. The apparatus of claim 7 wherein said controlling means comprises:

means for comparing said first mutual inductance with a set mutual inductance and for generating a first error signal; and means for adjusting at least one of the current and the voltage applied to said inductor in response to said first error signal.

10. The apparatus of claim 7 further comprising:

an air gap between said inductor and said outer surface of said solid product; and said first sense loop being positioned in said substantially transverse plane at a location in the range of from a point as close as possible to at least one of said solid product and said molten material head to a point about two thirds of said air gap from at least one of said solid product outer surface and said molten material outer surface.

11. The apparatus of claim 10 further comprising:

said first sense loop being positioned in said substantially transverse plane at a location in the range of from said point as close as possible to at least one of said solid product and said molten material head to a point about one half of said air gap from at least one of said solid product outer surface and said molten material outer surface.

12. The apparatus of claim 10 further comprising:

said first sense loop being positioned in said substantially transverse plane at a location in the range of from said point as close as possible to at least one of said solid product and said molten material head to a point about one quarter of said air gap from at least one of said solid product outer surface and said molten material outer surface.

13. The apparatus of claim 7 further comprising:

said first sense loop having a cross sectional dimension in said casting direction less than about 50% of said head height.

14. The apparatus of claim 13 further comprising:

said cross sectional dimension being less than about 25% of said head height.

15. The apparatus of claim 13 further comprising:

said cross sectional dimension being less than about 10% of said head height.

16. The apparatus of claim 10 further comprising:

a second sense loop positioned in a second plane substantially transverse to said casting direction at a location along a second axis parallel to said casting direction in the range of from a point substantially adjacent to said upstream surface of said molten material head to a point about three times said head height upstream of said interface; and said second sense loop sensing a second mutual inductance between said second loop and said inductor.

17. The apparatus of claim 16 further comprising:

said second sense loop being positioned in said second substantially transverse plane at a location in the range of from about 1.5 times to about 2 times said head height upstream of said interface.

18. The apparatus of claim 16 further comprising:

a non-magnetic shield; and said second sense loop being positioned substantially adjacent a surface of said shield.

19. The apparatus of claim 16 further comprising:

each said sense loop being formed by a metal or metal alloy ribbon coated with an electrical insulating material.

20. The apparatus of claim 16 wherein said controlling means comprises:

means for combining said first and second mutual inductances and generating a first signal indicative of said air gap;

means for comparing said first air gap signal with a set of air gap and generating an air gap error signal; and means for adjusting at least one of the current and voltage applied to said inductor in response to said air gap error signal.

21. The apparatus of claim 20 wherein said controlling means further comprises:

said combining means generating a second signal indicative of the location of said upstream head surface;

means for comparing said upstream surface location signal with a set upstream surface location signal and generating an upstream surface location error signal; and means for controlling said molten metal head height in response to said upstream surface location error signal.

22. A casting process including:

electromagnetically containing a head of molten material and forming said molten material into a solid product having a desired shape, said solid product being cast in a desired casting direction;

said containing and forming step comprising providing a containment inductor and applying a current and a voltage to said inductor for generating and applying a magnetic field to said molten material;

said containing and forming step further including forming a boundary between said molten material head and said solid product comprising a liquid-solid interface and an air gap between said inductor and an outer surface of said solid product;

said molten material head having a height measured in said casting direction along an outer surface of said molten material head from said interface to an upstream surface of said head;

positioning a sense loop to be more sensitive to changes in said air gap and less sensitive to the location of said upstream head surface;

said positioning step comprising positioning said sense loop between an inner surface of said inductor and at least one of said solid product outer surface and said molten material head outer surface in a plane substantially transverse to said casting direction and at a location along a first axis parallel to said casting direction in the range of from about a point substantially equal to said head height downstream of said liquid solid interface to about a point substantially equal to about one-half said head height upstream of said interface;

measuring an electrical parameter of said sense loop which is a function of the current induced in said sense loop by said inductor; and adjusting at least one of said current and said voltage applied to said inductor in response to said measured electrical parameter.

23. The process of claim 22 further comprising:

comparing said measured electrical parameter with a set parameter and generating an error signal; and said adjusting step comprising adjusting said at least one of said current and said voltage in response to said error signal.

24. The process of claim 22 wherein said masuring step comprises measuring the mutual inductance between said sense loop and said inductor.

25. The process of claim 22 wherein said measuring step comprises measuring the open circuit voltage of said sense loop.

26. The process of claim 22 wherein said positioning step comprises positioning said sense loop at a location along said axis in the range of from a point about said interface to a point about one-half said head height upstream of said interface.

27. A casting process comprising:

electromagnetically containing a head of molten material and forming said molten material into a solid product having a desired shape and size, said solid product being cast in a desired casting direction ;

said containing and forming step comprising providing a containment inductor and applying a current and voltage to said inductor for generating and applying a magnetic field to said molten material;

said containing and forming step including forming a boundary between said head of molten material and said solid product comprising a liquid-solid interface;

said molten material head having a height comprising a distance measured in said casting direction along an outer surface of said molten material head from said liquid-solid interface to an upstream surface of said molten material head;

positioning at least one sense loop between an inner surface of said inductor and at least one of an outer surface of said solid product and said molten material outer surface;

wherein said positioning step further comprising positioning said at least one sense loop in a first plane substantially transverse to said casting direction and at a location along a first axis parallel to said casting direction in the range of from about a point substantially equal to said head height downstream of said liquid-solid interface to a point substantially equal to about one-half said head height upstream of said interface;

sensing a first mutual inductance between said at least one sense loop and said inductor; and controlling at least one of said head height and said product size in response to said first mutual inductance.

28. The process of claim 27 wherein said positioning step comprises:

positioning said at least one sense loop along said first axis at a location in the range of from a point about said interface to a point about one-half said head height upstream of said interface.

29. The process of claim 27 wherein said controlling step comprises:

comparing said first mutual inductance with a set mutual inductance and generating a mutual inductance error signal; and adjusting at least one of the current and voltage applied to said inductor in response to said error signal.

30. The process of claim 27 further comprising:

providing at least one additional sense loop in a second plane substantially transverse to said casting direction at a location along a second axis parallel to said casting direction in the range of from a point substantially adjacent said upstream surface of said molten material head to a point about three times said head height upstream of said interface;

sensing a second mutual inductance between said at least one additional loop and said inductor; and said controlling step further comprising controlling at least one of said head height and said product size in response to said first and second mutual inductances.

31. The process of claim 30 wherein said controlling step further comprises:

combining said first and second mutual inductances and generating a first signal indicative of an air gap between said inductor and said solid product;

comparing said air gap signal with a set air gap and generating an air gap error signal; and adjusting at least one of the current and voltage applied to said inductor in response to said air gap error signal.

32. The process of claim 31 wherein said controling step further comprises:

said combining step further generating a signal indicative of the location of said upstream surface of said head;

comparing said upstream surface location signal with a set upstream surface location signal and generating a surface location error signal; and adjusting said head height in response to said surface location error signal.

* * * * *